US006102025A

United States Patent [19]

Merritt et al.

[11] Patent Number: 6,102,025

[45] Date of Patent: Aug. 15, 2000

[54] METHOD OF BREAKING CONCRETE PILES

[76] Inventors: Robert Arthur Merritt, Slade Park Farm, Pensilva, Liskeard, Cornwall, United Kingdom, PL14 5NA; Jimmy Elliott, Golowjy View, Darite, Liskeard, Cornwall, United Kingdom, PL14 5JH

[21] Appl. No.: 09/155,109

[22] PCT Filed: Mar. 24, 1997

[86] PCT No.: PCT/GB97/00826

§ 371 Date: May 10, 1999

§ 102(e) Date: May 10, 1999

[87] PCT Pub. No.: WO97/36058

PCT Pub. Date: Oct. 2, 1997

[30] Foreign Application Priority Data

Mar. 22, 1996 [GB] United Kingdom ..... 9606079

[51] Int. Cl.[7] ..... B28D 1/32

[52] U.S. Cl. ..... 125/23.01; 125/12

[58] Field of Search ..... 125/23.01, 12, 125/16.01; 405/232, 303, 231, 246, 247, 227, 228

[56] References Cited

U.S. PATENT DOCUMENTS

| | | | |
|---|---|---|---|
| 4,124,015 | 11/1978 | Isaksson | 125/23.01 |
| 4,197,828 | 4/1980 | Schellhorn | 125/23.01 |
| 4,979,489 | 12/1990 | Abbasov et al. | 125/23.01 |
| 5,007,593 | 4/1991 | Berczes | 125/23.01 |
| 5,413,086 | 5/1995 | Trudeau | 125/23.01 |

*Primary Examiner*—Derris H. Banks
*Attorney, Agent, or Firm*—Nath & Associates; Harold L. Novick

[57] ABSTRACT

A method of breaking a reinforced concrete pile comprising the steps of treating the reinforcement which is to be incorporated in the portion of the pile to be broken away so as to isolate the reinforcement in that portion from the concrete cast around it to form the pile, forming a hole in the pile in a transverse plane substantially perpendicular to the major axis of the pile in a position corresponding to the intended level of the bottom of the portion to be broken away, and applying to the concrete of the pile from within the hole forces which act towards opposite ends of the pile to split the pile in or substantially in the transverse plane.

16 Claims, No Drawings

METHOD OF BREAKING CONCRETE PILES

The present invention relates to a method of breaking concrete piles.

Reinforced concrete piles are widely used in civil engineering to provide a firm foundation for structures, particularly those built on soft or incompetent ground, and can be cast in situ or precast.

Piles are cast or emplaced so that they extend to a predetermined height above the level required for construction purposes, this height being at least equal to the amount of reinforcement that is to be incorporated in the structure to be supported by the piles, and the concrete is then broken down to the required level. When the concrete is broken away, the reinforcement is exposed at the tops of the piles and is left ready for incorporation in the structure.

Traditionally, the breaking of concrete piles is carried out by manual labour and is a slow, arduous and expensive process which produces a considerable amount of loose debris for disposal. Even if mechanical means are used, close manual supervision is necessary as the required level is approached in order to prevent damage to the pile below that level. One method of breaking a concrete pile is diclosed in JP-A-88011218.

The object of the present invention is to provide a quick, efficient and relatively clean method of breaking reinforced concrete piles.

According to the present invention, there is provided a method of breaking a reinforced concrete pile, comprising the steps of treating the reinforcement which is to be incorporated in the portion of the pile to be broken away so as to isolate the reinforcement in that portion from the concrete cast around it to form the pile, forming a hole in the pile in a transverse plane perpendicular or substantially perpendicular to the major axis of the pile in a position corresponding to the intended level of the bottom of the portion to be broken away, and applying to the concrete of the pile from within the hole forces which act towards opposite ends of the pile to split the pile in or substantially in the transverse plane.

The isolating treatment of the reinforcement, which typically comprises steel bars or steel mesh, may consist of the coating of the reinforcement with a release agent or debonding agent to prevent adhesion between the concrete and the reinforcement but, in a preferred embodiment, the reinforcement is covered by sleeving or a layer of foamed plastics. The latter is particularly suitable for use with corrugated reinforcement as it fills the corrugations and prevents any keying between the reinforcement and the concrete. In other embodiments, the reinforcement may be coated with a material which shrinks in the heat generated by the concrete as it sets and thus creates a void between the reinforcement and the surrounding concrete.

Preferably, the hole in the pile is formed by a portion of piping or tubing which is inserted through the reinforcement at the required or intended level before the concrete is cast. In some cases, however, the hole may be drilled into the pile after the concrete has set. In a preferred embodiment, the hole extends through the pile to promote the formation of a split across the entire width thereof.

The splitting forces may be exerted by oppositely-acting wedges inserted into the hole in the pile. In a preferred embodiment, a conventional rock and concrete splitter with hydraulically-operated wedges is used.

Once the concrete has been split, the broken-away portion of the pile can be removed substantially in one piece and the portion removed can be crushed so that the constituents of the concrete can be recycled for re-use.

In one embodiment of the method, a collar may be placed around the pile with one edge in the plane of the intended split in order to ensure the formation of the clean break. This avoids the need for any hand finishing of the head of the pile left after removal of the broken-away portion.

One embodiment of a method of breaking reinforced concrete piles according to the present invention will now be described, purely by way of example.

During the process of casting a concrete pile reinforced by steel bars, before the concrete is poured, the end parts of the reinforcement bars which are to be incorporated in the structure supported by the pile are coated with a layer of foamed plastics from the ends of those parts to a position corresponding to the intended level of the bottom of the portion of the pile to be broken away. A length of plastics piping having a diameter sufficient to accommodate the wedge set of a hydraulic concrete splitter and a length sufficient to extend through the entire width of the pile is then inserted between the reinforcement bars and is attached thereto at the intended level, in a plane substantially perpendicular to the major axis of the pile.

The concrete which is to form the pile is then poured or cast around the reinforcement bars and the plastics piping in a conventional manner and is allowed to set. The foamed plastics coating on the reinforcement bars isolates the end parts of the bars from the concrete at the respective end of the pile to prevent any adhesion between those parts of the bars and the concrete and the piping defines a hole through the pile.

Once the concrete has set (and, if precast, the pile has been put in position on site), the wedge set of a hydraulic concrete splitter, for example of the type available under the trade mark DARDA, is inserted into the hole formed by the plastics piping and the splitter is then actuated to apply to the concrete from within the hole vertical forces which act towards opposite ends of the pile to split the concrete substantially horizontally in the plane of the piping. The hydraulic splitter which is preferred for the splitting step of the method has a wedge set comprising two semi-cylindrical counter wedges and a wedge which is movable axially between the counter wedges from a retracted position in which the counter wedges are together and form a cylinder (of a diameter which can be accommodated by the piping used to form the hole in the pile) and an advanced position in which the counter wedges are forced apart by the wedge to exert a splitting force of up to 3581 kN. The use of such a splitter produces a clean break in the pile.

After splitting, the broken-away portion of the pile can be removed to expose the upper parts of the reinforcement bars for incorporation in the structure to be supported by the pile.

What is claimed is:

1. A method of breaking a reinforced concrete pile, the method comprising the steps of:

treating reinforcement which is to be incorporated in a portion of the pile to be broken away so as to isolate the reinforcement in that portion from concrete cast around the reinforcement to form the pile;

coating the reinforcement with a material which shrinks as the concrete sets to create a void between the reinforcement and the surrounding concrete;

forming a hole in the pile in a transverse plane substantially perpendicular to a major axis of the pile in a position corresponding to an intended level of a bottom of the portion to be broken away; and inserting oppositely-acting wedges in the hole, and forcing the wedges apart so as to apply to the concrete of the pile from within the hole forces which act towards opposite ends of the pile to split the pile in or substantially in the transverse plane.

2. A method according to claim 1, in which the reinforcement comprises steel bars or steel mesh.

3. A method according to claim 1, in which the reinforcement is covered by sleeving or a layer of foamed plastics.

4. A method according to claim 1, in which the reinforcement is coated with a release agent or a debonding agent.

5. A method according to claim 1, which the hole in the pile is formed by piping or tubing inserted at a required or intended level before the concrete is cast.

6. A method according to claim 1, in which the hole is formed to extend through the pile.

7. A method according to claim 1, in which the splitting forces are exerted by a splitter which has a wedge set comprising two semi-cylindrical counter wedges and an axially-movable actuation wedge to force apart the counter wedges.

8. A method according to claim 1, in which a collar is placed around the pile with one edge in a plane of an intended split.

9. A method of breaking a reinforced concrete pile, the method comprising the steps of:

treating reinforcement which is to be incorporated in a portion of the pile to be broken away so as to isolate the reinforcement in that portion from concrete cast around the reinforcement to form the pile;

forming a hole in the pile in a transverse plane substantially perpendicular to a major axis of the pile in a position corresponding to an intended level of a bottom of the portion to be broken away;

inserting oppositely-acting wedges in the hole, and forcing the wedges apart so as to apply splitting forces to the concrete of the pile from within the hole which act toward opposite ends of the pile to split the pile in or substantially in the transverse plane, wherein the splitting forces are exerted by a splitter which has a wedge set comprising two semi-cylindrical counter wedges and an axially-movable actuation wedge to force apart the counter wedges.

10. A method according to claim 9, in which the reinforcement is coated with a material which shrinks as the concrete sets to create a void between the reinforcement and the surrounding concrete.

11. The method according to claim 9, in which the reinforcement comprises steel bars or steel mesh.

12. The method according to claim 9, in which the reinforcement is covered by sleeving or a layer of foamed plastics.

13. The method according to claim 9, in which the reinforcement is coated with a release agent or a debonding agent.

14. The method according to claim 9, in which the hole in the pile is formed by piping or tubing inserted at a required or intended level before the concrete is cast.

15. The method according to claim 9, in which the hole is formed to extend through the pile.

16. The method according to claim 9, in which a collar is placed around the pile with one edge in a plane of an intended split.

* * * * *